US010141662B2

(12) United States Patent
Bernard et al.

(10) Patent No.: US 10,141,662 B2
(45) Date of Patent: Nov. 27, 2018

(54) METAL CLIP FOR ELECTRICALLY CONNECTING A CONDUCTIVE WIRE TO A METAL ELEMENT

(71) Applicant: A. RAYMOND ET CIE, Grenoble (FR)

(72) Inventors: Nicolas Bernard, Grenoble (FR); Norman Philipp, Lorrach (DE)

(73) Assignee: A. RAYMOND ET CIE, Grenoble (FR)

( * ) Notice: Subject to any disclaimer, the term of this patent is extended or adjusted under 35 U.S.C. 154(b) by 0 days.

(21) Appl. No.: 15/578,583

(22) PCT Filed: Jun. 1, 2016

(86) PCT No.: PCT/FR2016/051303

§ 371 (c)(1),
(2) Date: Nov. 30, 2017

(87) PCT Pub. No.: WO2016/193615

PCT Pub. Date: Dec. 8, 2016

(65) Prior Publication Data

US 2018/0159249 A1 Jun. 7, 2018

(30) Foreign Application Priority Data

Jun. 1, 2015 (FR) ..... 15 54952

(51) Int. Cl.
*H01R 4/64* (2006.01)
*H01R 4/2437* (2018.01)
(Continued)

(52) U.S. Cl.
CPC ..... *H01R 4/646* (2013.01); *H01R 4/2437* (2013.01); *H01R 4/36* (2013.01); *H01R 4/4818* (2013.01)

(58) Field of Classification Search
CPC ..... H01R 4/646; H01R 4/2437; H01R 4/36; H01R 4/4818
(Continued)

(56) References Cited

U.S. PATENT DOCUMENTS 4,973,259 A * 11/1990 Sachs ..... H01R 9/0512 248/61
4,993,959 A * 2/1991 Randolph ..... H01R 4/64 439/855
(Continued)

FOREIGN PATENT DOCUMENTS

CA 1026836 A 2/1978
EP 0504469 A1 9/1992
(Continued)

OTHER PUBLICATIONS

International Search Report for International Application No. PCT/FR2016/051303 dated Aug. 19, 2016, 3 pages.
(Continued)

*Primary Examiner* — Alexander Gilman
(74) *Attorney, Agent, or Firm* — TraskBritt

(57) ABSTRACT

This disclosure concerns a metal clip for electrically connecting a conductive wire to a planar metal element, the metal clip having an S-shaped cross-section and being composed of three wings, a first wing and a second wing defining a first longitudinal recess allowing the metal clip to be attached to an edge of the planar metal element, the second wing and the third wing defining a second longitudinal recess. The second recess is provided with connection means for receiving the end of the conductive wire and for maintaining electrical contact between the conductive wire and the metal clip.

13 Claims, 8 Drawing Sheets

(51) Int. Cl.
*H01R 4/36* (2006.01)
*H01R 4/48* (2006.01)

(58) Field of Classification Search
USPC ..... 439/786
See application file for complete search history.

(56) References Cited

U.S. PATENT DOCUMENTS 5,451,167 A * 9/1995 Zielinski ..... H01R 4/245 439/435
5,480,310 A * 1/1996 Baum ..... H01R 9/2691 439/716
D409,143 S * 5/1999 Yoshiura ..... D13/133
5,928,006 A * 7/1999 Franks, Jr. ..... H01R 4/66 439/443
D459,302 S * 6/2002 Malin ..... D13/133
6,877,996 B1 * 4/2005 Franks, Jr. ..... H01R 4/42 439/782
7,686,625 B1 * 3/2010 Dyer ..... H01R 4/64 439/857
2011/0151703 A1 * 6/2011 Parker ..... H01R 4/36 439/338
2014/0220834 A1 * 8/2014 Rizzo ..... H01L 31/042 439/834

FOREIGN PATENT DOCUMENTS

EP 2528166 A1 11/2012
FR 2694141 A1 1/1994

OTHER PUBLICATIONS

International Written Opinion for International Application No. PCT/FR2016/051303 dated Aug. 19, 2016, 6 pages.

* cited by examiner

METAL CLIP FOR ELECTRICALLY CONNECTING A CONDUCTIVE WIRE TO A METAL ELEMENT

CROSS-REFERENCE TO RELATED APPLICATIONS

This application is a national phase entry under 35 U.S.C. § 371 of International Patent Application PCT/FR2016/051303, filed Jun. 1, 2016, designating the United States of America and published as International Patent Publication WO 2016/193615 A1 on Dec. 8, 2016, which claims the benefit under Article 8 of the Patent Cooperation Treaty to French Patent Application Serial No. 1554952, filed Jun. 1, 2015, for "Metal Clip for Electrically Connecting a Conductive Wire to a Metal Element," the contents of each of which are incorporated herein in their entirety by this reference.

TECHNICAL FIELD

This disclosure relates to a metal clip for electrically connecting a conductive wire to a planar metal element.

BACKGROUND

FR 2694141 discloses a grounding clip being composed of an S-shaped curved one-piece metal plate so as to define two elastically deformable slots oriented opposite one another and separated by a wall. A slot is intended to be engaged onto a planar metallic support, the other one to receive the ground wire. To avoid any stripping operation, the walls of such grounding clip has cutouts folded toward the inside of each slot in order to protrude therefrom and to form suitable knives able to cut the insulating sheath of the ground wire on an adequate depth to ensure electrical contact between the ground wire and the grounding clip.

The orientation of the slots and of the knives requires dragging a segment of the ground wire in translation into the slot in order to cut the insulating sheath and to establish the electrical contact. This operation is not easily achieved manually, especially when the free space around the clip and the planar metallic support is restricted or confined.

Once the grounding clip has been mounted with the ground wire on the metallic support, the ground wire is maintained and oriented in a plane substantially parallel to the metallic support and in the longitudinal direction of the clip. It is mainly maintained by the elastic deformation of the slot which it is inserted into. But the ground wire is then not reliably secured on the grounding clip from which it can be easily detached, by sliding.

The document EP2528166 discloses another known electrical connection metal clip, wherein the conductive wire is maintained in a direction perpendicular to the plane defined by the support. It allows engaging the clip onto the support in a single operation and, at the same time, establishing the electrical contact with the conductive wire. This characteristic is not always advantageous and it is sometimes preferable to be able to carry out these two steps independently.

BRIEF SUMMARY

One object of this disclosure is therefore to provide an electrical connection metal clip making it possible to reliably and easily secure a conductive wire.

In order to reach this aim, the object of this disclosure provides for a metal clip for electrically connecting a conductive wire to a planar metal element, with the metal clip having an S-shaped cross-section and being composed of three wings, with a first wing and a second wing defining a first longitudinal recess allowing the metal clip to be attached to one edge of the planar metal element, with the second wing and the third wing defining a second longitudinal recess. According to the invention, the second recess is provided with connection means for receiving the end of the conductive wire and for maintaining electrical contact between the conductive wire and the metal clip.

According to other advantageous and not restrictive characteristics of the invention, taken alone or in combination:

- the connection means are so arranged as to receive and maintain the end of the conductive wire when same is oriented in a direction having a transverse component, relative to the metal clip.
- the first wing and/or the second wing is/are provided with at least one cut forming an elastic lug oriented toward the inside of the first recess so as to improve the attachment of the metal clip to the planar metal element and the electrical contact thereof.
- the metal clip is made of a single metal part and the connection means include:
  - a clamping lug formed by a cutout in the third wing and oriented toward the inside of the second recess;
  - a guided opening formed in the third wing for introducing the end of the conductive wire into the second recess and for blocking same between the clamping lug and the second wing.
- the clamping lug and the guided opening are arranged on the third wing so as to allow the introduction of the end of the conductive wire toward the bottom of the second recess.
- the bottom of the second recess is provided with a clearance opening for the conductive wire to jut out above the metal clip.
- the three wings are each provided with one opening, facing each other and allowing the passage of a screw; and wherein the additional part for attaching the wire consists of a nut cooperating with a screw inserted into the openings so as to allow the clamping of the end of the conductive wire between the second wing and the nut.
- the nut is composed of a threaded cylindrical bore extending beyond the opening of the third wing and a crush collar.
- at least a portion of the free edges of the third wing is folded toward the inside of the second recess in order to limit the movement of the nut in the second recess.
- the part for attaching the wire is composed of a part protruding through an opening formed on the third wing and provided with a side opening (for receiving the end of the conductive wire).
- a portion of the perimeter of the side opening of the protruding part is composed of a blade.
- the protruding part is so configured as to be moved in a sink direction perpendicular to the plane defined by the third wing or to be rotationally moved.

BRIEF DESCRIPTION OF THE DRAWINGS

This disclosure will be better understood when reading the following description of particular, not restrictive, embodiments of the disclosure while referring to the appended figures among which.

DETAILED DESCRIPTION OF THE INVENTION

In order to simplify the forthcoming description, the same references will be used for elements either identical or performing the same function in the various embodiments of the invention.

An electrical connection metal clip 1 according to the invention, as is illustrated in each one of the embodiments shown in FIGS. 1*a*, 2*a*, 3*a*, and 4*a*, is composed of an S-shaped curved metal plate thus having an S-shaped cross-section. "Wing" refers to each of the three essentially flat portions of the metal plate defining such S shape.

Figure 1A:
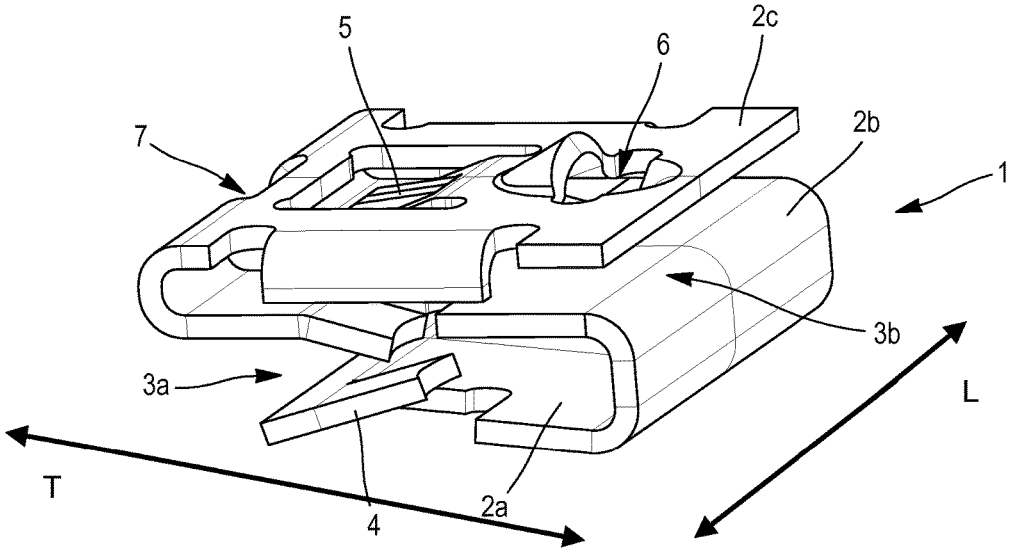
FIGS. 1*a*, 2*a*, 3*a* and 4*a* show four embodiments of the invention.
Figure 1B:
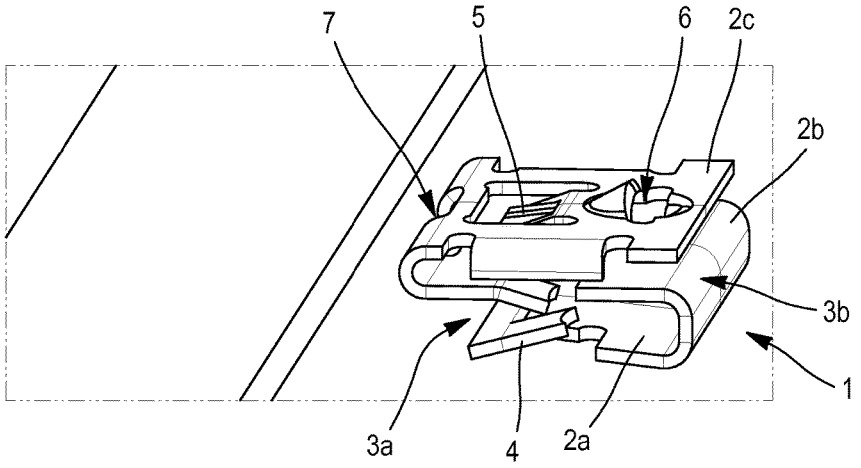
FIGS. 1*b* to 1*e* illustrate the use of the electrical connection metal clip 1 of the first embodiment.
Figure 1C:
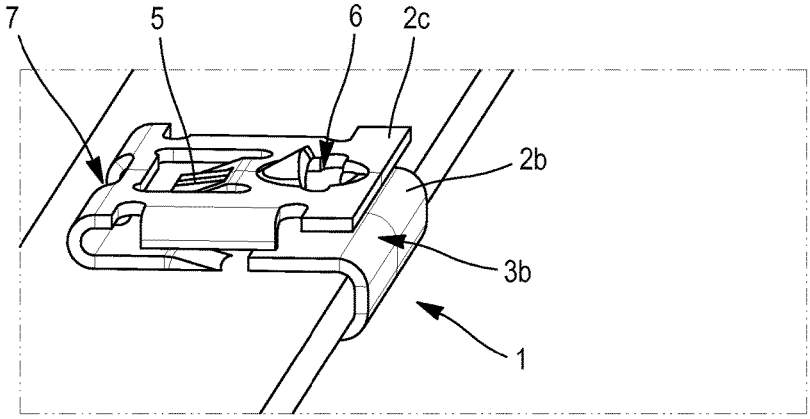

For clarity, FIG. 1*a* shows the axis or the longitudinal direction, marked L, and the axis or the transverse direction, marked T. Such definitions of course apply to all the other appended figures.

A first wing 2*a* and a second wing 2*b*, secured at a first curved area which positions same one facing the other, define a first longitudinal recess 3*a*. Such recess is intended to be engaged onto one edge of a planar metal element which a wire is desired to be electrically connected to. For this purpose, the distance separating the first wing 2*a* and the second wing 2*b*, as defined by the dimensions of the first curved area, is so selected as to substantially match the thickness of the planar metal element.

The elastic deformation of the first curved area maintains the metal clip 1 on the planar metal element and electrical contact between same. To improve such electrical contact, it can be provided to form, on the first wing 2*a* and/or on the second wing 2*b*, a cutout or a plurality of cutouts for defining one or more elastic lug(s) 4 oriented toward the inside of the first recess 3*a*. The bearing force exerted by the elastic lug 4 helps firmly maintain the metal clip on the planar metal element. The low penetration of the end of such elastic lug 4 into the metal element by scoring effect upon engaging same facilitates the electrical contact.

One cutout is preferably made on each of the two side edges of the first wing 2*a* and of the second wing 2*b* in order to define four elastic lugs 4, with the lugs 4 of the first wing 2*a* being positioned opposite the lugs 4 of the second wing 2*b*.

The second wing 2*b* is integral with a third wing 2*c*, through a second curved area positioning these two wings 2*b*, 2*c* facing each other, and thereby defining a second longitudinal recess 3*b*.

According to the invention, the second recess 3*b* is provided with connection means for receiving the end of a conductive wire which is desired to be electrically connected to the planar metal element. Such means are so configured as to receive the end of the conductive wire and to maintain electrical contact between the conductive wire and the metal clip 1.

The solution provided by this disclosure is advantageous for two reasons. First, during a connection operation performed manually, bringing the end of the conductive wire into the connection means, by moving same along its main axis, is easier than dragging a section of such conductive wire in translation into a recess, and in a direction perpendicular to the main axis of the wire, as is the case in the first document of the prior art referred to in the preamble. Secondly, this disclosure makes it possible to separate the engagement of the first recess 3*a* of the metal clip 1 onto the planar metal element of the electrical connection of the conductive wire to the connection means. This characteristic can be advantageous when the space around the clip and the planar metal element is restricted or confined.

The connection means are preferably so arranged as to receive and maintain the end of the conductive wire when same is oriented in a direction having a transverse component, relative to the metal clip 1. It may thus be a direction having an angle of +/−60° relative to the transverse direction of the clip, and preferably an angle of +/−30° relative to such direction.

The end of the conductive wire is advantageously inserted into the connection means in a direction from the opening to the bottom of the second recess 3*b*.

FIG. 1 shows a first embodiment 1 of the invention, wherein the connection means comprise:

a clamping lug 5 formed by a cutout in the third wing 2*c*, and oriented toward the inside of the second recess 3*b*, and a guided opening 6 formed in the third wing 2*c* for introducing the end of the conductive wire into the second recess 3*b* and for blocking same between the clamping lug 5 and the second wing 2*b*.

As shown in FIG. 1*a*, the clamping lug 5 and the guided opening 6 are so arranged on the third wing 2*c* as to allow the introduction of the conductive wire toward the bottom of the second recess 3*b*. However, both such elements can be so arranged as to allow the introduction of the conductive wire in the opposite direction.

The bottom of the recess 3*b* can be provided with a clearance opening 7 for the conductive wire to jut out above the metal clip 1 and allowing the possible subsequent removal thereof.

FIGS. 1*b* to 1*e* illustrate the use of the electrical connection metal clip 1 of the first embodiment. In a first step, the metal clip 1 is joined with the planar metal element by engaging the first recess 3*a* onto an outer edge thereof. The clip engagement can be done manually or using a tool such as a hammer, for example. The lugs 4 exert a bearing force onto the planar metal element and, by a score effect, the ends thereof penetrate into the material of the metal element, which helps establish the electrical contact.

Figure 1D:
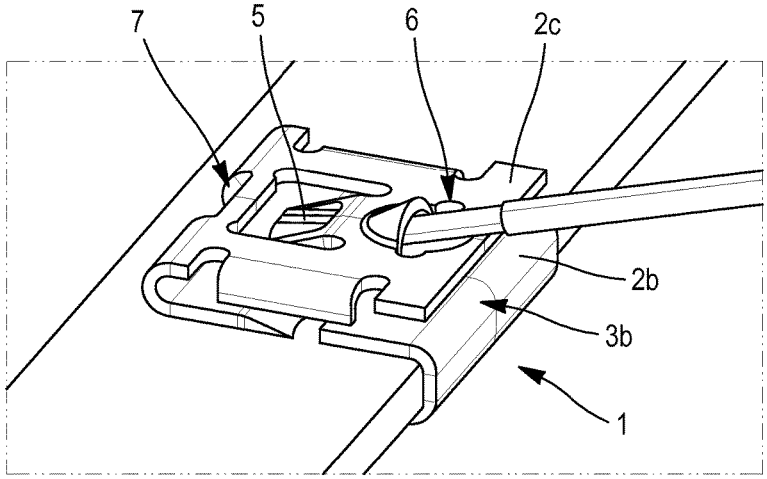
Figure 1E:
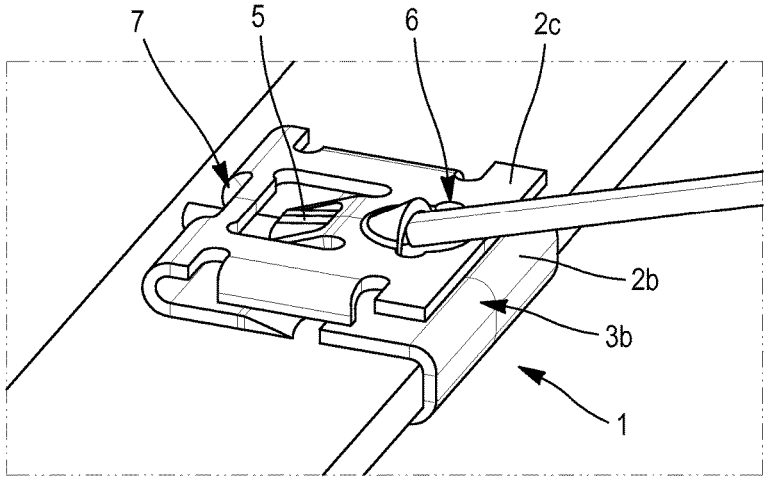

In a second step, shown in FIG. 1*d*, the stripped end of a conductive wire is manually introduced into the guided opening 6. Such opening is so configured as to guide the feed of the conductive wire toward the clamping lug 5. The feed of the conductive wire results in the lifting of such lug, which enables the progress of the stripped part of the wire toward the bottom of the recess. When the latter is provided with a clearance opening 7, the conductive wire may continue to progress, for example, until the insulating jacket abuts the guided opening 6 as shown in FIG. 1*e*.

Once positioned, the stripped portion of the conductive wire is maintained in electrical contact with the metal clip 1 by the clamping effect of the lug 5. The slight penetration of the clamping lug into the conductive wire prevents the conductive wire from being extracted. Therefore, the disengagement of the conductive wire from the metal clip 1 requires cutting the wire, for example, using cutting pliers, at the guided opening 6, so as to enable extracting the residual wire segment through the clearance opening 7.

This first embodiment is advantageous in that it makes it possible to connect the conductive wire to the planar metal element without requiring tools. Besides, the metal clip 1 according to this first embodiment is composed of a single metal part, which makes it particularly simple to manufacture.

The other three embodiments of this disclosure which follow are different from the first embodiment in that the metal clip 1 connection means are composed of an additional part for attaching the conductive wire, positioned in the second recess 3*b*.

Figure 2A:
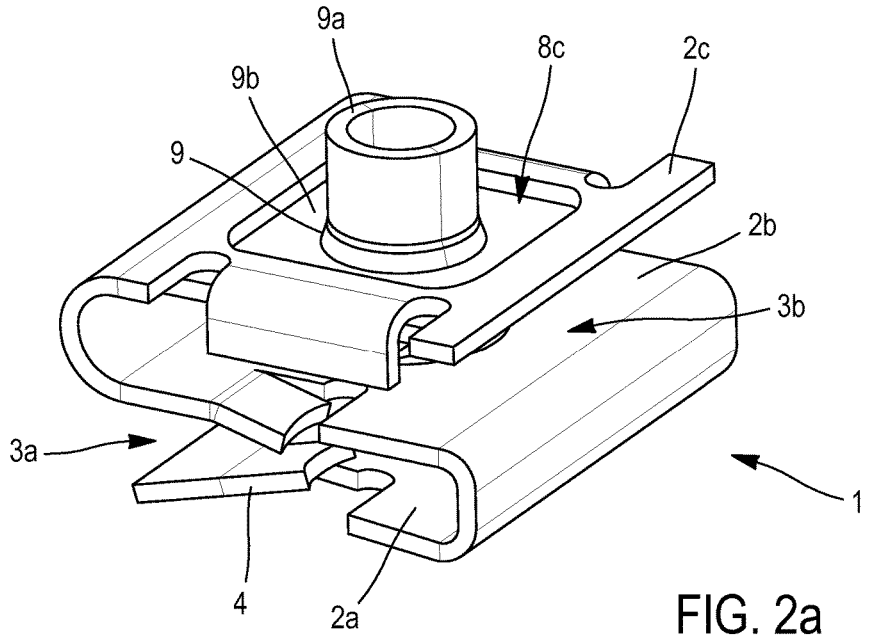
Figure 2B:
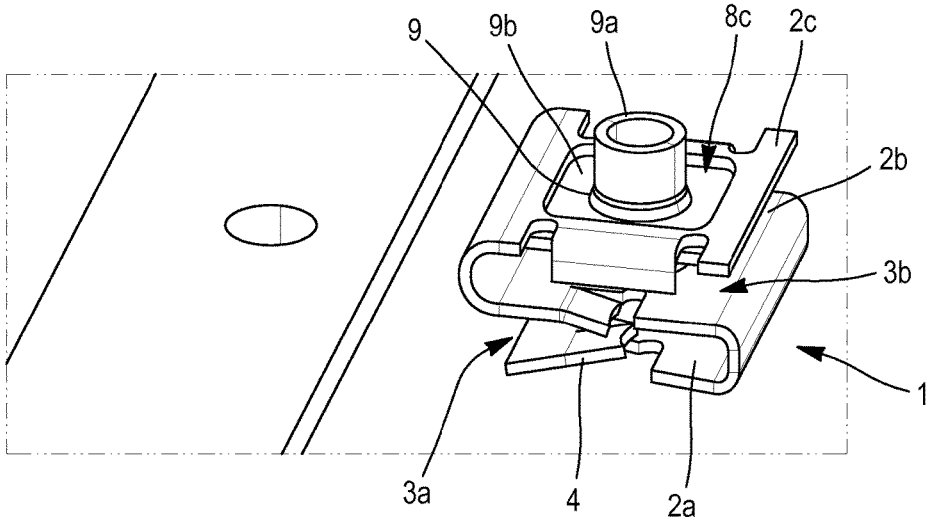
FIGS. 2*b* to 2*e* illustrate the use of the electrical connection metal clip 1 of the second embodiment.
Figure 2C:
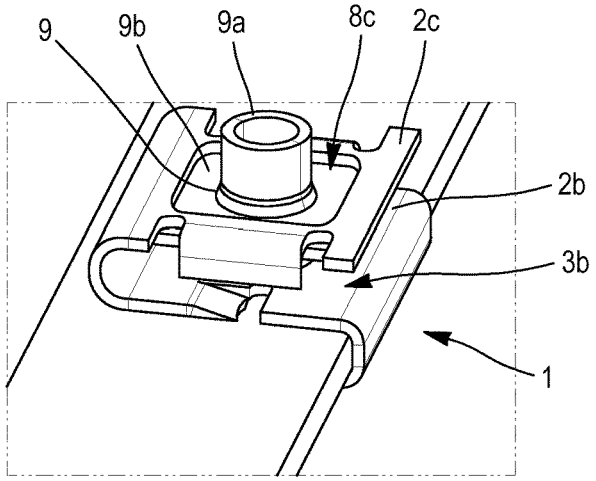

Thus, according to the second embodiment of this disclosure shown in FIG. 2*a*, the part for attaching the conductive wire is composed of a nut 9. The wings 2*a*, 2*b*, 2*c* are each provided with one opening 8*a*, 8*b*, 8*c*, facing each other and allowing the passage of a screw 9', and among which the opening 8*c* of the wing 2*c* only is visible in FIG. 2*a* (see also FIG. 2*d*).

The nut 9 may be composed of a threaded cylindrical bore 9*a*, so configured as to cooperate with the screw 9', and a crush collar 9*b*.

To prevent the nut 9 from sliding out of the second recess 3*b*, the cylindrical bore 9*a* extends beyond the opening 8*c* of the third wing 2*c*.

At least a portion of the free edges of the third wing 2*c* is folded toward the inside of the second recess 3*b*, thereby forming a stop for the crush collar in order to block the rotation of the nut 9 upon introducing the screw 9'.

FIGS. 2*b* to 2*e* illustrate the use of the electrical connection metal clip 1 of the second embodiment. Like the first embodiment, the metal clip 1 is attached to the planar metal element. However, in this second embodiment, the planar metal element is provided with an opening for the passage of a screw and the clip 1 is so mounted as to align such opening with the openings 8*a*, 8*b*, 8*c*.

Figure 2D:
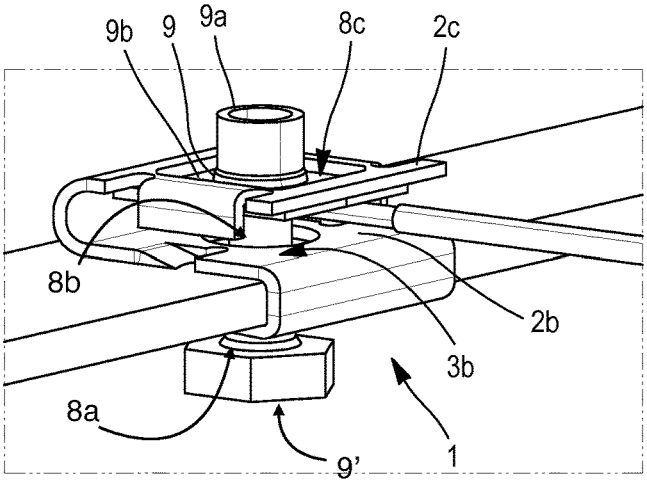
Figure 2E:
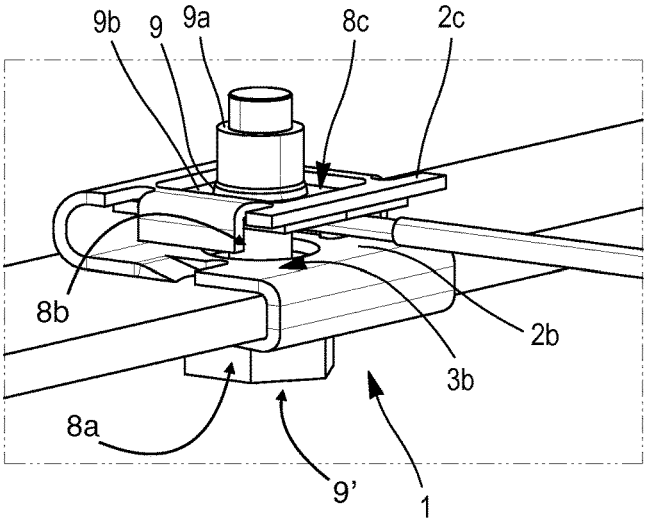

In a second step, shown in FIG. 2*d*, the screw 9' is inserted into the metal clip 1, which results in clearing a free space in the second recess 3*b* between the nut 9 and the second wing 2*b*. The screw may be partially screwed onto the nut 9. The stripped end of the conductive wire can then be introduced into the free space of the second recess 3*b*.

In a final step shown in FIG. 2, tightening the screw 9' right down causes the nut 9 to move toward the second wing 2*b* so as to crush the wire between the nut 9 (specifically against the crush collar 9*b*) and the second wing 2*b* of the metal clip 1.

This second embodiment is advantageous in that it makes disconnecting the conductive wire from the metal clip 1 easy by simply unscrewing the screw 9'.

Figure 3A:
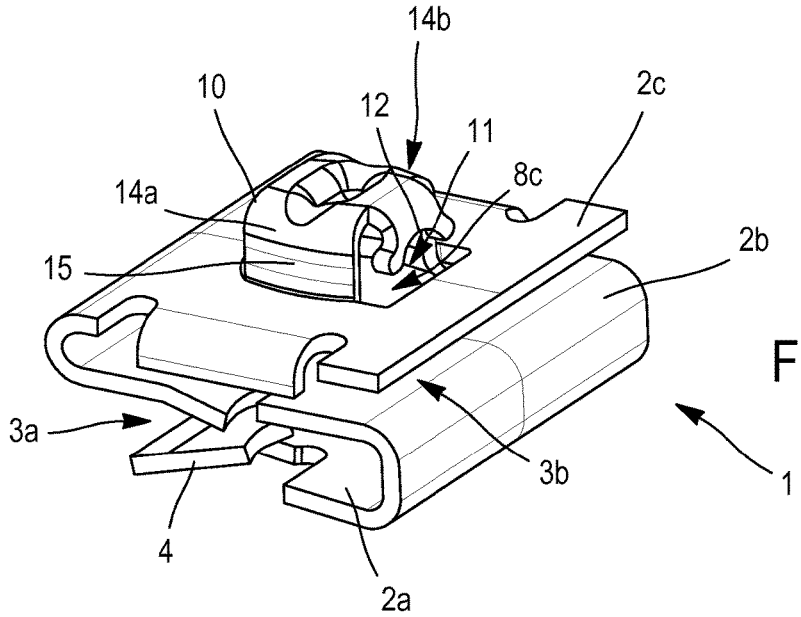
Figure 4A:
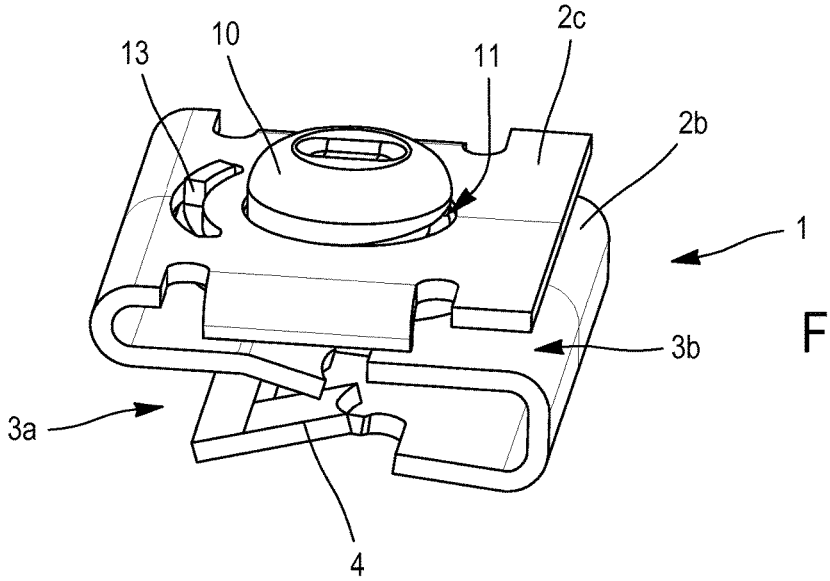

The other two embodiments of this disclosure which will be presented are different from the previous embodiments, in that they can enable the electrical contact of a conductive wire without it having been previously stripped. For this purpose, and as shown in FIGS. 3*a* and 4*a*, the wire attaching part is composed of a part 10 protruding through an opening 8*c* formed on the third wing 2*c*.

The protruding part 10 is provided with a side opening 11 for receiving the end of the conductive wire when same is oriented in a direction having a transverse component, relative to the metal clip 1.

The protruding part 10 can be moved so as to enable the clamping of the conductive wire between the perimeter of the side opening 11 and a surface of the third wing 2*c*.

At least a portion of the perimeter of the side opening 11 of the protruding part 10 is advantageously sharpened to compose a blade 12 making it possible to cut the insulating sheath of the conductive wire and the electrical contact of the conductive wire and the metal clip 1.

In the third embodiment of this disclosure shown in FIG. 3*a*, the protruding part has two L-shaped flanks 14*a*, 14*b* secured to an upper portion of the protruding part 10 at elastically deformable links. Both sides 14*a*, 14*b* are forced to bear onto the edges of the cutout forming the opening 8*c*, which makes it possible to hold the protruding part 10 in position. The protruding part 10 can be moved in a sink direction perpendicular to the plane defined by the third wing 2*c*, so as to position same in a blocking position. Optionally and advantageously, the blocking of the protruding part 10 can be improved in such electrical contact position by means of surface patterns 15, such as ribs, formed on the sides 14*a*, 14*b* of the protruding part 10 so as to house the protruding edges of the cutout forming the opening 8*c*.

FIGS. 3*b* to 3*e* illustrate the use of the electrical connection metal clip 1 of the third embodiment.

Figure 3B:
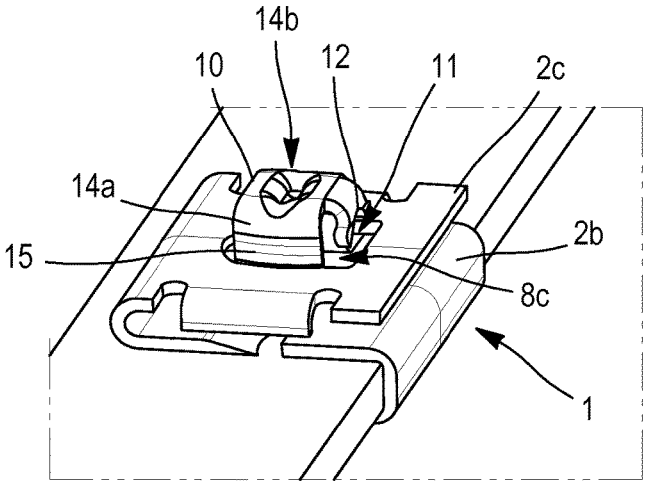
FIGS. 3*b* to 3*e* illustrate the use of the electrical connection metal clip 1 of the third embodiment.
Figure 3C:
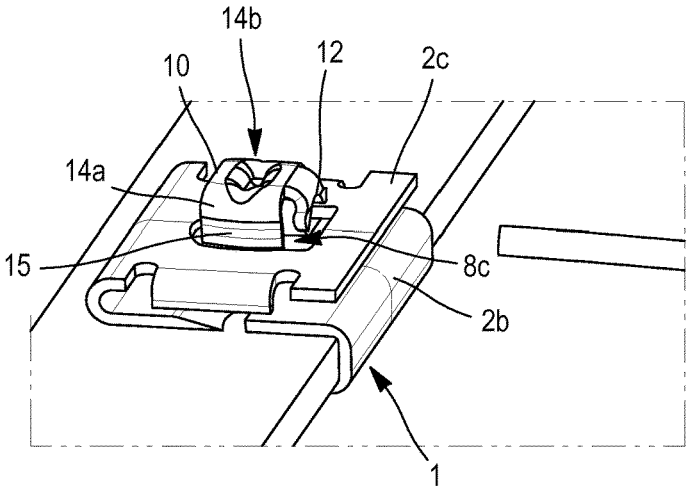
Figure 3D:
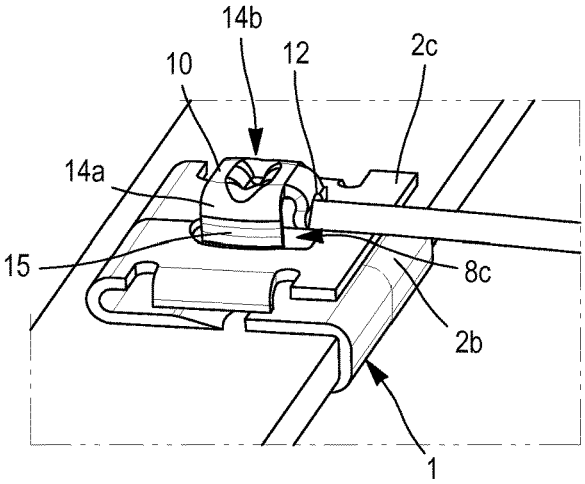
Figure 3E:
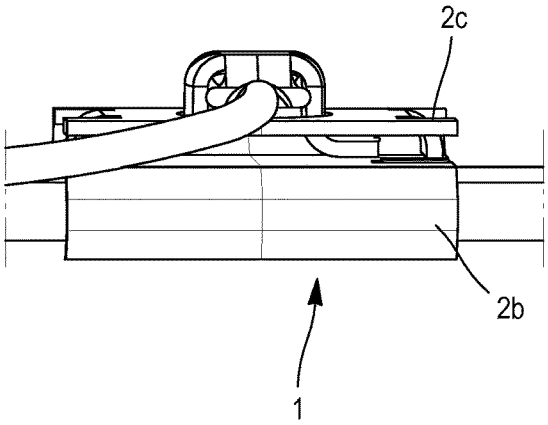

Similarly to the previous embodiment, the metal clip 1 is attached to the planar metal element, as shown in FIG. 3*b*. In a second step, shown in FIGS. 3*c* and 3*d*, the end of the conductive wire, which may or may not be stripped, is inserted into the opening 11 of the protruding part 10.

In a final step, shown in FIG. 3, the protruding part 10 is moved in the sink direction, either manually or using a tool such as a screwdriver or a hammer, and placed in the blocking position through the elastic bearing of the flanks 14*a*, 14*b* onto the edges of the cutout forming the opening 8*c*, and possibly through the recess of the protruding edges of the cutout forming the opening 8*a* in the surface patterns 15 formed on the flanks 14*a*, 14*b*.

During such movement, the blade 12 cuts the insulating sheath of the conductive wire and provides electrical contact with the wire.

The fourth embodiment of this disclosure shown in FIG. 4*a*, is an alternative solution of the third embodiment which has just been disclosed.

In this fourth embodiment, the protruding part 10 has a circular section enabling the rotational movement thereof in the recess 3*b*. For this purpose, the protruding part 10 is provided with an imprint on the top thereof enabling the positioning of a screwdriver or a similar tool. A stopping device 13 is used to limit the rotation of the protruding part between a wire insertion position and a blocking position.

The side opening 11 has an oblong shape and forms a ramp. The dimensions thereof are sufficient to receive the end of the conductive wire when the latter is oriented in a direction having a transverse component, relative to the metal clip 1 and when the protruding part 10 is oriented in its insertion position.

FIGS. 4*b* to 4*e* illustrate the use of the electrical connection metal clip 1 of the fourth embodiment.

Figure 4B:
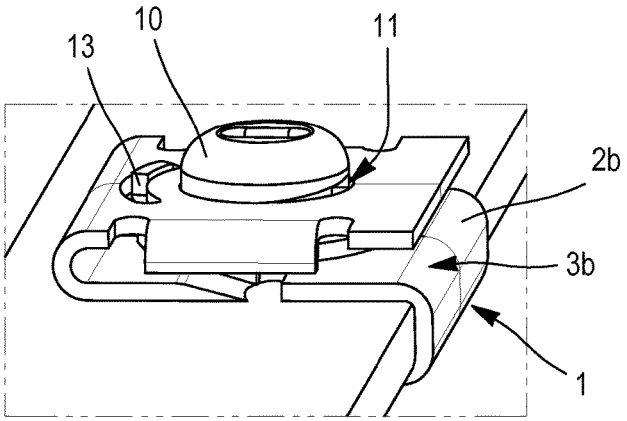
FIGS. 4*b* to 4*e* illustrate the use of the electrical connection metal clip 1 of the fourth embodiment.

Similarly to the previous embodiment, the metal clip 1 is attached to the planar metal element, as shown in FIG. 4*b*.

Figure 4C:
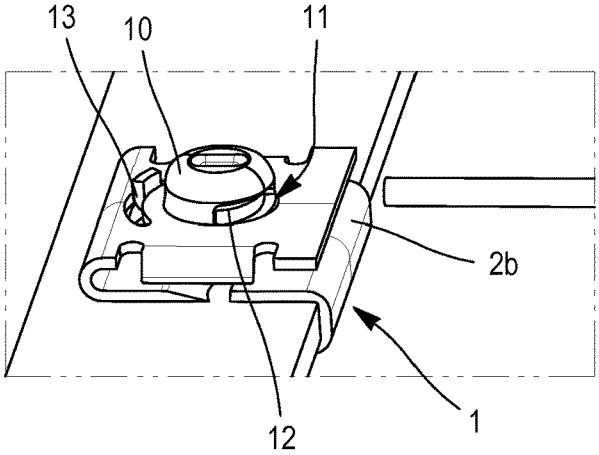
Figure 4D:
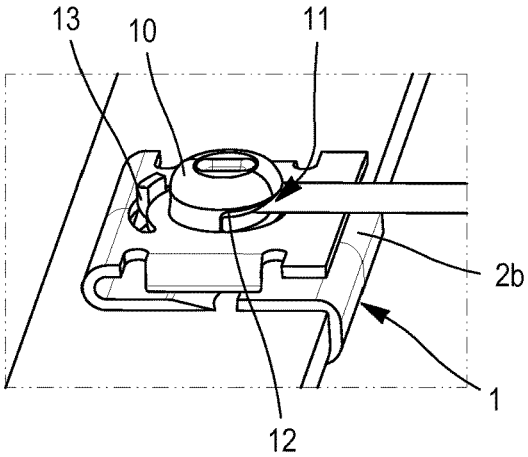

In a second step, shown in FIGS. 4*c* and 4*d*, the protruding part 10 is advantageously oriented in an insertion position making it possible to bring the end of the conductive wire to the metallic clip 1 and to position same in the oblong side opening 11 forming a ramp.

Figure 4E:
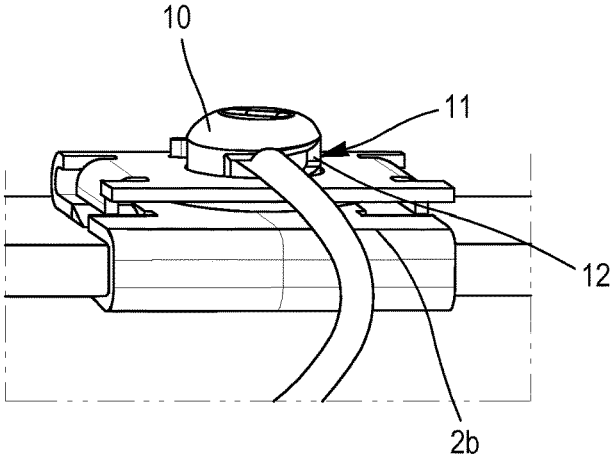

In a final step shown in FIG. 4*e*, the protruding part 10 is rotated by means of a tool, for placing same in the blocking position. Such rotation causes the cutting of the insulating sheath by the blade 12 formed on the ramp of the side opening 11, and the establishment of the electrical contact of the conductive wire with the metal clip 1.

The attaching metal clip 1 can be easily obtained from a sheet or a flat and thin metal plate, by stamping, folding and/or cutting operations. The clip, once obtained, can be subjected to heat treatments so as that the mechanical characteristics thereof can be enhanced and it can be submitted to surface treatments.

The invention claimed is:

1. A metal clip for electrically connecting a conductive wire to a planar metal element, with the metal clip having an S-shaped cross-section and being composed of three wings, with a first wing and a second wing defining a first longitudinal recess allowing the metal clip to be attached to one edge of the planar metal element, with the second wing and the third wing defining a second longitudinal recess, the second recess including connection means for receiving the end of the conductive wire and for maintaining electrical contact between the conductive wire and the metal clip, wherein the connection means comprises an additional part for attaching the conductive wire in the second recess that includes a part protruding through an opening formed on the third wing, with the protruding part being provided with a side opening for receiving the end of the conductive wire, with the protruding part being movable so as to allow the clamping of the conductive wire between the perimeter of the opening of the protruding part and a surface of the third wing.

2. The metal clip of claim 1, wherein the first wing and/or the second wing includes at least one cut forming an elastic lug oriented toward the inside of the first recess so as to improve the attachment of the metal clip to the planar metal element and the electrical contact.

3. The metal clip of claim 1, wherein at least a portion of the perimeter of the side opening of the protruding part includes a blade for cutting an insulating sheath of the conductive wire and the electrical contact between the conductive wire and the metal clip.

4. The metal clip of claim 3, wherein the protruding part is configured so as to be moved in a sink direction perpendicular to the plane defined by the third wing.

5. The metal clip of claim 3, wherein the protruding part is configured so as to be rotationally moved.

6. The metal clip of claim 1, wherein the protruding part is configured so as to be moved in a sink direction perpendicular to the plane defined by the third wing.

7. The metal clip of claim 1, wherein the protruding part is configured so as to be rotationally moved.

8. The metal clip of claim 1, wherein the first wing and/or the second wing includes at least one cut forming an elastic lug oriented toward the inside of the first recess so as to improve the attachment of the metal clip to the planar metal element and the electrical contact.

9. A metal clip for electrically connecting a conductive wire to a planar metal element, with the metal clip having an S-shaped cross-section and being composed of three wings, with a first wing and a second wing defining a first longitudinal recess allowing the metal clip to be attached to one edge of the planar metal element, with the second wing and the third wing defining a second longitudinal recess, the second recess including connection means for receiving the end of the conductive wire and for maintaining electrical contact between the conductive wire and the metal clip, wherein the connection means include:

a clamping lug formed by a cutout in the third wing and oriented toward the inside of the second recess; and a guided opening formed in the third wing for introducing the end of the conductive wire into the second recess and for blocking the conductive wire between the clamping lug and the second wing.

10. The metal claim of claim 9, wherein the metal clip consists of a single metal part.

11. The metal clip of claim 10, wherein the clamping lug and the guided opening are arranged on the third wing so as to allow the introduction of the end of the conductive wire toward the bottom of the second recess.

12. The metal clip of claim 11, wherein the bottom of the second recess is provided with a clearance opening for the conductive wire to jut out above the metal clip.

13. The metal clip of claim 9, wherein the first wing and/or the second wing includes at least one cut forming an elastic lug oriented toward the inside of the first recess so as to improve the attachment of the metal clip to the planar metal element and the electrical contact.

* * * * *